US007188833B1

(12) United States Patent
Glaser

(10) Patent No.: US 7,188,833 B1
(45) Date of Patent: Mar. 13, 2007

(54) MULTILEVEL CLAMP DEVICE

(76) Inventor: Richard D. Glaser, 2661 Hwy. QQ, Green Bay, WI (US) 54311

( * ) Notice: Subject to any disclaimer, the term of this patent is extended or adjusted under 35 U.S.C. 154(b) by 318 days.

(21) Appl. No.: 10/859,313

(22) Filed: Jun. 2, 2004

(51) Int. Cl.
*B25B 1/00* (2006.01)

(52) U.S. Cl. ..... 269/152

(58) Field of Classification Search ..... 299/43, 299/45, 282, 905, 243, 53, 47, 246, 111, 172; 403/364

See application file for complete search history.

(56) References Cited

U.S. PATENT DOCUMENTS

| | | | | |
|---|---|---|---|---|
| 912,543 | A | 2/1909 | Cobb | |
| 1,432,597 | A | 10/1922 | Geczynski | |
| 2,274,428 | A | 2/1942 | Odin | |
| D151,429 | S | 10/1948 | Clauss | |
| 2,662,433 | A | 12/1953 | Braun | |
| 3,861,664 | A | 1/1975 | Durkee | |
| 4,095,913 | A * | 6/1978 | Pettersson et al. | 403/364 |
| 4,341,375 | A | 7/1982 | Romanin | |
| 4,930,753 | A * | 6/1990 | Alvyn | 256/26 |
| 4,948,108 | A | 8/1990 | Sullivan | |
| 5,050,755 | A * | 9/1991 | Strawder | 220/23.4 |
| 5,413,236 | A * | 5/1995 | Kenevan | 220/4.28 |
| 5,597,259 | A * | 1/1997 | Bogaerts et al. | 403/263 |
| 5,623,757 | A | 4/1997 | Durfee, Jr. | |
| 5,816,568 | A | 10/1998 | Fox | |
| 5,893,551 | A | 4/1999 | Cousins et al. | |
| 6,394,438 | B1 * | 5/2002 | Glaser | 269/43 |

* cited by examiner

*Primary Examiner*—Lee D. Wilson

(57) ABSTRACT

A multilevel clamp device for allowing multiple items to be clamped at the same time. The multilevel clamp device includes a plurality of clamps being for clamping the frames. Each of the clamps comprises a pair of end walls. The end walls of one of the clamps selectively engages the end walls of another one of the clamps to inhibit inadvertent movement of one of the clamps with respect to the other one of the clamps when one of the clamps is stacked onto another one of the clamps. Each of the clamps comprises a clamping assembly coupled between the end walls of the associated one of the clamps. The clamping assembly of each of the clamps is designed for engaging one of the frames and clamping an associated one of the frames between the clamping assembly and one of the end walls of the associated one of the clamps.

17 Claims, 3 Drawing Sheets

MULTILEVEL CLAMP DEVICE

BACKGROUND OF THE INVENTION

1. Field of the Invention

The present invention relates to vises and more particularly pertains to a new multilevel clamp device for allowing multiple items to be clamped at the same time.

2. Description of the Prior Art

The use of vises is known in the prior art. U.S. Pat. No. 5,623,757 describes a device for clamping multiple items between a fixed center jaw and two movable outer jaws. Another type of vise is U.S. Pat. No. 5,893,551 having a machinable low profile jaws which include a stationary jaw positioned between two movable jaws to allow multiple items to be clamped by the vise by positioning each of the items between the stationary jaw and one of the movable jaws. U.S. Pat. No. 2,274,428 has a mechanism for advancing a movable jaw of a vise towards a stationary jaw of the vise to inhibit lifting up of the work being clamped by the vise. U.S. Pat. No. 1,432,597 has a stationary jaw and a movable jaw that is selectively moved with relation to the stationary jaw to allow items to be clamped between the jaws. U.S. Pat. No. 912,543 has an arm that is positioned in the member and is selectively extendable from the arm to change the position of tail stock to provide a greater accommodation of items of varying sizes. U.S. Pat. No. 4,341,375 has a pair of movable jaws positioned between a pair stationary jaws with one of plurality of items being selectively clamped between one of the movable jaws and one of the stationary to allow a pair of items to be clamped by the vise. U.S. Pat. No. 5,816,568 has a plurality of carriages that are slidable and lockable along a base with columns rotatably coupled to the carriages to allow the columns to be positioned to allow items of irregular shape to be clamped and secured. U.S. Pat. No. 2,662,433 has a plurality of movable jaws positioned between a pair of stationary jaws to allow an item to be coupled between each adjacent set of jaws. U.S. Pat. No. 3,861,664 has a clamping device for accommodating at leas one ski or a pair of skis depending on the orientation of the ski or skis with respect to the jaws and the spacing member. U.S. Pat. No. 4,948,108 has a device that supports a circuit board during curing, transport, testing and assembly and allows for multiple units to be stacked together. U.S. Pat. No. Des. 151,429 shows an adjustable vise-jaw holder.

While these devices fulfill their respective, particular objectives and requirements, the need remains for a device that has certain improved features allowing for multiple clamps to be stacked on top of each other and allow those clamps to each clamp an separate item.

This application is related to my utility patent U.S. Pat. No. 6,394,438, issued May, 28, 2002. While the apparatus disclosed in my previous patent is highly suitable for maintaining alignment of the clamps when stacked, I have discovered that the alignment aspect of that apparatus can be enhanced to provide an even greater level of maintenance of the alignment of the clamps when the clamps are stacked.

SUMMARY OF THE INVENTION

The present invention meets the needs presented above by each of the end walls of each of the clamps with a plurality of tab portions and a plurality of grooves where the tab portions of one of the clamps are positioned in the grooves of another one of the clamps to maintain alignment and positioning of the clamps when the clamps are stacked.

Still yet another object of the present invention is to provide a new multilevel clamp device that allow a user to allow items being clamped to be stacked to conserve space.

Even still another object of the present invention is to provide a new multilevel clamp device that maintains alignment of clamps to inhibit the items being clamped being set at undesired angles when the items are clamped to allow glue to dry.

To this end, the present invention generally comprises a plurality of clamps being designed for engaging the frames whereby the clamps are for clamping the frames. Each of the clamps comprises a pair of end walls. The end walls of one of the clamps selectively engages the end walls of another one of the clamps to inhibit inadvertent movement of one of the clamps with respect to the other one of the clamps when one of the clamps is stacked onto another one of the clamps. Each of the clamps comprises a clamping assembly. The clamping assembly is coupled between the end walls of the associated one of the clamps. The clamping assembly of each of the clamps is designed for engaging one of the frames whereby the clamping assembly is for clamping an associated one of the frames between the clamping assembly and one of the end walls of the associated one of the clamps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
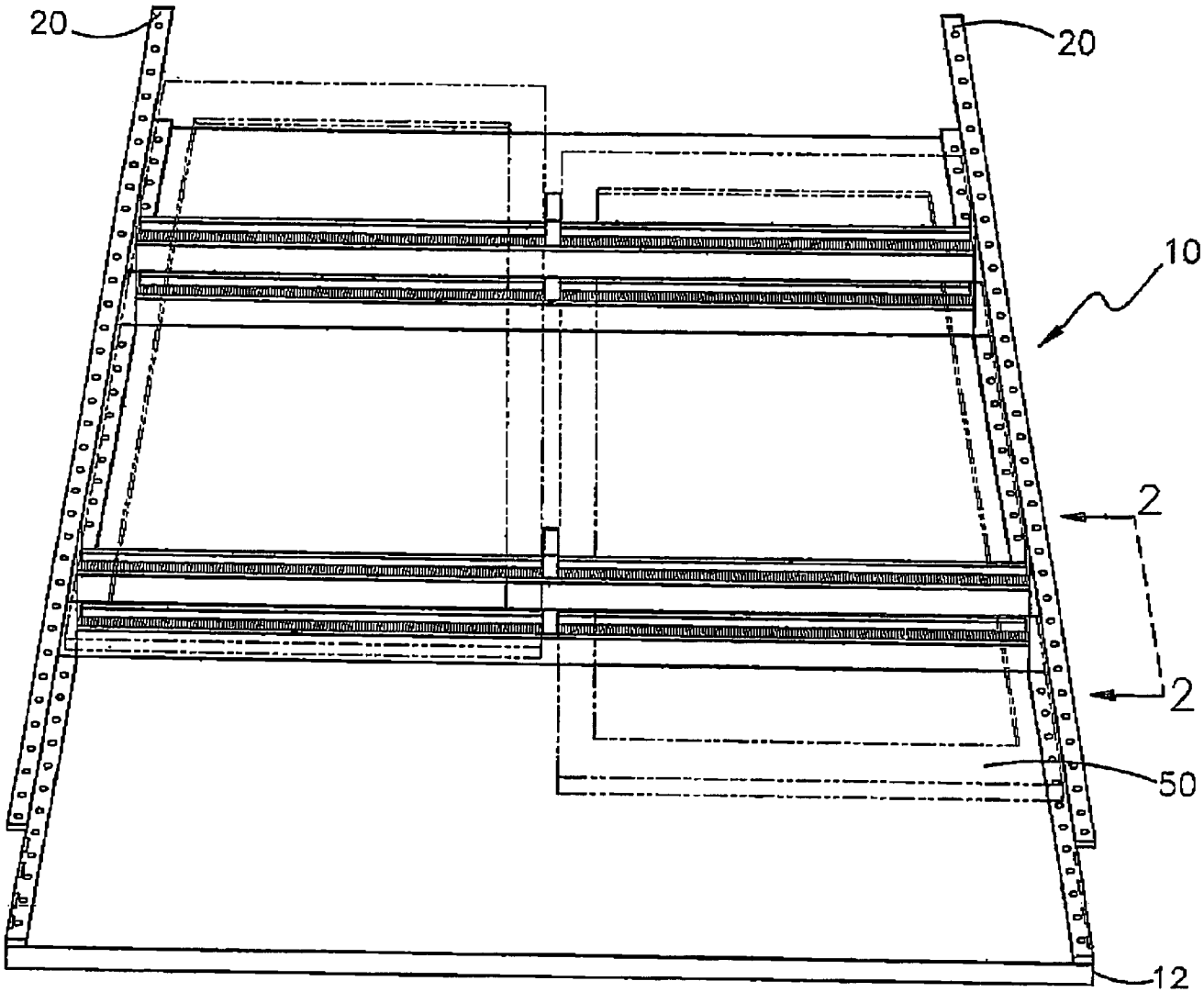
FIG. 1 is a perspective view of a new mutlilevel clamp device according to the present invention.
Figure 2:
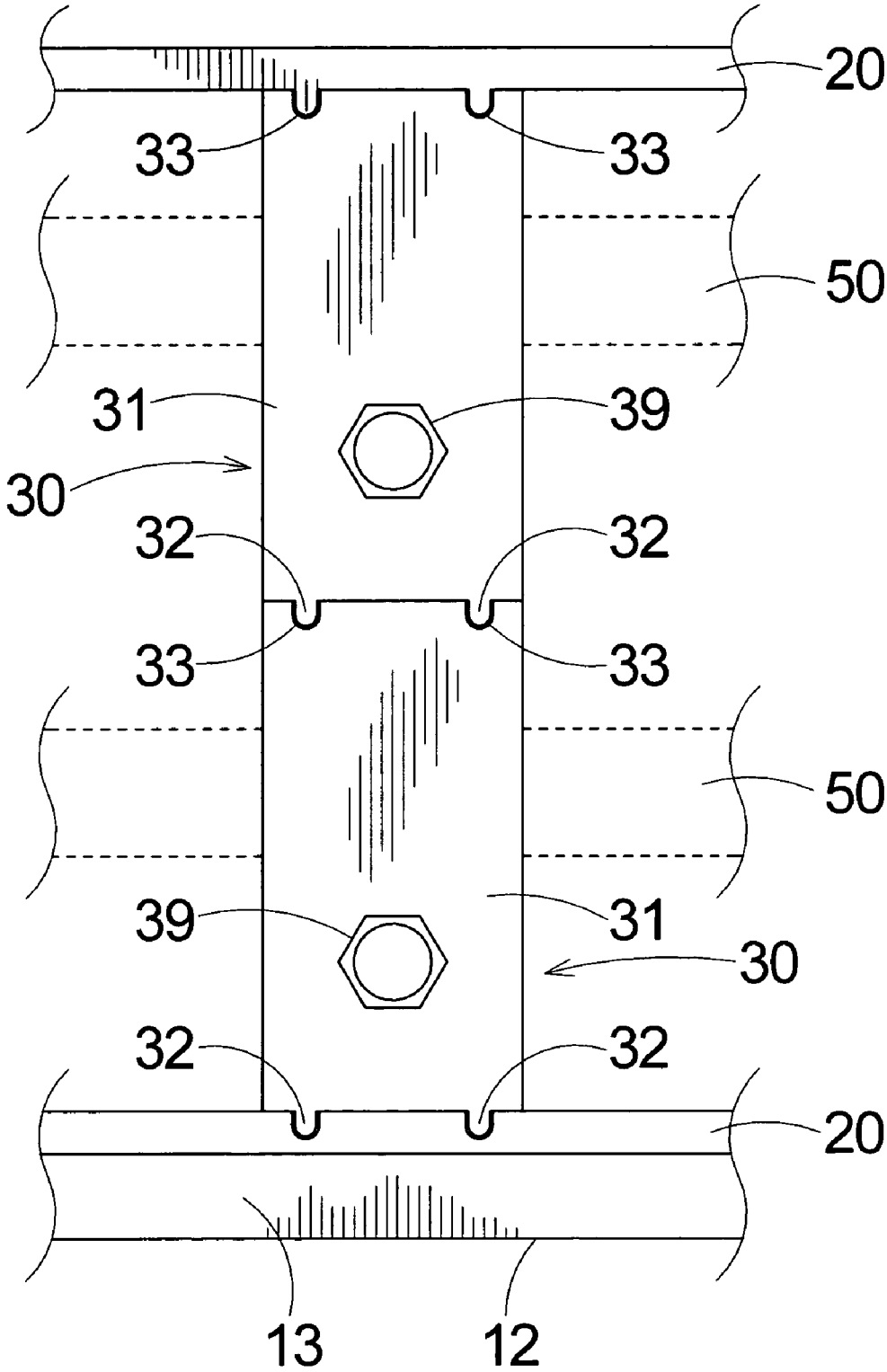
FIG. 2 is a side view taken along line 2—2 of FIG. 1 of the present invention.
Figure 3:
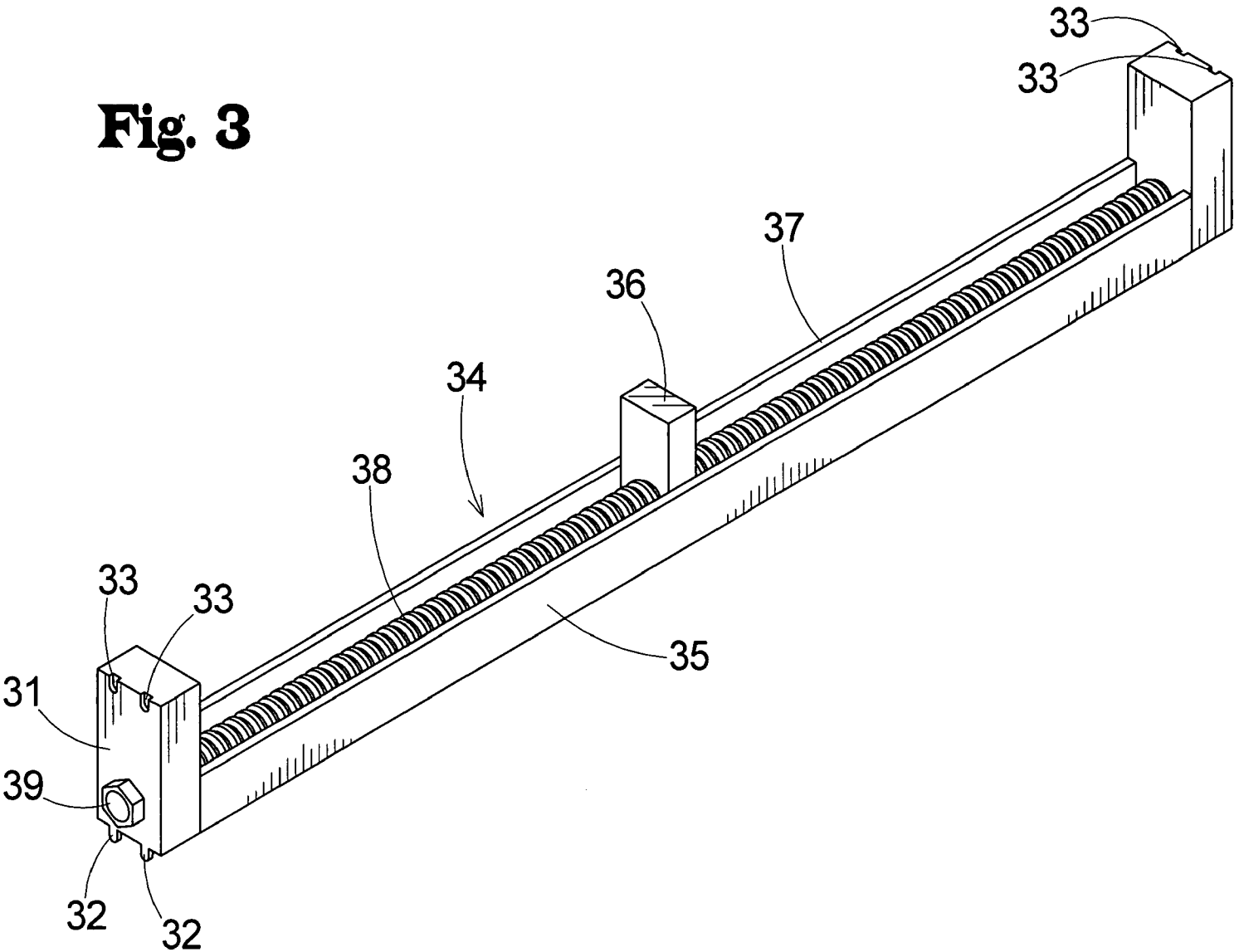
FIG. 3 is a perspective view of a clamp of the present invention.

With reference now to the drawings, and in particular to FIGS. 1 through 6 thereof, a new multilevel clamp device embodying the principles and concepts of the present invention and generally designated by the reference numeral 10 will be described.

As best illustrated in FIGS. 1 through 6, the multilevel clamp device 10 generally comprises a plurality of clamps 30 being designed for engaging the frames 50 whereby the clamps 30 are for clamping the frames 50. Each of the clamps 30 comprises a pair of end walls 31. The end walls 31 of one of the clamps 30 selectively engages the end walls 31 of another one of the clamps 30 to inhibit inadvertent movement of one of the clamps 30 with respect to the other one of the clamps 30 when one of the clamps 30 is stacked onto another one of the clamps 30.

Each of the end walls 31 of each of the clamps 30 comprises a plurality of tab portions 32 and a plurality of grooves 33. Each of the grooves 33 extends into the associated one of the end walls 31. The tab portions 32 of each of the end walls 31 extend downwardly from the associated one of the end walls 31 whereby the tab portions 32 are positioned opposite the grooves 33 of the associated one of the end walls 31. The tab portions 32 of the end walls 31 of one of the clamps 30 is selectively positioned in the grooves 33 of the end walls 31 of another one of the clamps 30 to maintain positioning of one of the clamps 30 with respect to other one the clamps 30 when the clamps 30 are stacked.

Each of the clamps 30 comprises a clamping assembly 34. The clamping assembly 34 is coupled between the end walls 31 of the associated one of the clamps 30. The clamping assembly 34 of each of the clamps 30 is designed for engaging one of the frames 50 whereby the clamping assembly 34 is for clamping an associated one of the frames 50 between the clamping assembly 34 and one of the end walls 31 of the associated one of the clamps 30.

The clamping assembly 34 of each of the clamps 30 comprises a bar 35 and a block 36. The block 36 is slidably coupled to the bar 35 whereby the block 36 is selectively slid along a length of the bar 35. The bar 35 is coupled between the end walls 31 of the associated one of the clamps 30 whereby the block 36 is selectively positioned between the end walls 31 of the associated one of the clamps 30. The block 36 is designed for engaging one of the frames 50 to clamp the associated one of the frames 50 between the block 36 and one of the end walls 31 of the associated one of the clamps 30.

The bar 35 of the clamping assembly 34 of each of the clamps 30 comprises a channel 37. The channel 37 extends into the bar 35 and extends along a length of the bar 35. The block 36 is slidably positioned in the channel 37 of the bar 35 whereby the block 36 is selectively slid along the length of the channel 37 to accommodate frames 50 positioned between one of the end walls 31 and the block 36. The block 36 extends upwardly from the channel 37 of the bar 35 whereby the block 36 is designed for engaging one of the frames 50.

The clamping assembly 34 of each of the clamps 30 comprises a rod 38. The rod 38 is positioned in the channel 37 of the bar 35. The rod 38 is rotatably coupled to the end walls 31 of the associated one of the clamps 30. The block 36 is operationally coupled to the rod 38 whereby the block 36 is slid along the channel 37 of the bar 35 when the rod 38 is rotated. The rod 38 is threaded whereby the rod 38 threadably engages the block 36. The block 36 moves along the rod 38 and slides along the channel 37 when the rod 38 is rotated.

The clamping assembly 34 of each of the clamps 30 comprises a pair of bolt head 39*s*. Each of the bolt head 39*s* is coupled to the rod 38 whereby one of the bolt head 39*s* is positioned opposite the other one of the bolt head 39*s*. The bolt head 39*s* extend outwardly from the associated one of the end walls 31 whereby each of the bolt head 39*s* is selectively engaged to rotated the rod 38 to slide the block 36 along the channel 37 of the bar 35.

A plurality of mountings 20 selectively engage the end walls 31 of the clamps 30. The mountings 20 are for maintaining alignment of the clamps 30 when the clamps 30 are used to clamp the frames 50.

A panel 12 is coupled to a pair of the mountings 20. The mountings 20 are positioned adjacent a pair of side edges 13 of the panel 12 whereby the one of the mountings 20 is positioned opposite the other of the mountings 20. The panel 12 is for maintaining positioning of the mountings 20 and the clamps 30 when the clamps 30 are engaged by the mountings 20 coupled to the panel 12.

In use, the user may position one of the frames 50, or other items to be clamped, on the bar 35 of at least one of the clamps 30. The bolt head 39*s* are then rotated to allow the block 36 to be positioned against the frame and clamp the frame between the block 36 and one of the end walls 31 of the associated one of the clamps 30. Another one of the clamps 30 may be selectively positioned on top of the other one of the clamps 30 by aligning the tab portions 32 of the upper one of the clamps 30 with the grooves 33 of the lower one of the clamps 30 which allow multiple frames 50 to be clamped at the same time.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multilevel clamp device for clamping multiple frames at different levels, the multilevel clamp device comprising:

a plurality of clamps for engaging the frames such that said clamps are for clamping the frames, each of said clamps comprising a pair of end walls, said end walls of one of said clamps selectively engaging said end walls of another one of said clamps to inhibit inadvertent movement of one of said clamps with respect to the other one of said clamps when one of said clamps is stacked onto another one of said clamps; and each of said clamps comprising a clamping assembly, said clamping assembly being coupled between said end walls of the associated one of said clamps, said clamping assembly of each of said clamps being for engaging one of the frames such that said clamping assembly is for clamping an associated one of the frames between said clamping assembly and one of said end walls of the associated one of said clamps;

wherein each of said end walls of each of said clamps comprise a plurality of tab portions and a plurality of grooves, each of said grooves extending into the associated one of said end walls, said tab portions of each of said end walls extending downwardly from the associated one of said end walls such that said tab portions are positioned opposite said grooves of the associated one of said end walls, said tab portions of said end walls of one of said clamps being selectively positionable in said grooves of said end walls of another one of said clamps to maintain positioning of one of said clamps with respect to other one said clamps when said clamps are stacked.

2. The multilevel clamp device as set forth in claim 1, further comprising:

said clamping assembly of each of said clamps comprising a bar and a block, said block being slidably coupled to said bar such that said block is selectively slid along a length of said bar, said bar being coupled between said end walls of the associated one of said clamps such that said block is selectively positioned between said end walls of the associated one of said clamps, said block being for engaging one of the frames to clamp the associated one of the frames between said block and one of said end walls of the associated one of said clamps.

3. The multilevel clamp device as set forth in claim 2, further comprising:

said bar of said clamping assembly of each of said clamps comprising a channel, said channel extending into said bar and extending along a length of said bar, said block being slidably positioned in said channel of said bar such that said block is selectively slid along the length of said channel to accommodate frames positioned between one of said end walls and said block, said block extending upwardly from said channel of said bar such that said block is engagable with one of the frames.

4. The multilevel clamp device as set forth in claim 3, further comprising:

said clamping assembly of each of said clamps comprising a rod, said rod being positioned in said channel of said bar, said rod being rotatably coupled to said end walls of the associated one of said clamps, said block being operationally coupled to said rod such that said block is slid along said channel of said bar when said rod is rotated.

5. The multilevel clamp device as set forth in claim 4, further comprising:

said rod being threaded such that said rod threadably engages said block, said block moving along said rod and sliding along said channel when said rod is rotated.

6. The multilevel clamp device as set forth in claim 4, further comprising:

said clamping assembly of each of said clamps comprising a pair of bolt heads, each of said bolt heads being coupled to said rod such that one of said bolt heads is positioned opposite the other one of said bolt heads, said bolt heads extending outwardly from the associated one of said end walls such that each of said bolt heads is selectively engaged to rotated said rod to slide said block along said channel of said bar.

7. The multilevel clamp device as set forth in claim 4, further comprising:

said clamping assembly of each of said clamps comprising a pair of bolt heads, each of said bolt heads being coupled to said rod such that one of said bolt heads is positioned opposite the other one of said bolt heads, said bolt heads extending outwardly from the associated one of said end walls such that each of said bolt heads is selectively engaged to rotated said rod to slide said block along said channel of said bar.

8. The multilevel clamp device as set forth in claim 1, further comprising:

a plurality of mountings selectively engaging said end walls of said clamps, said mountings being for maintaining alignment of said clamps when said clamps are used to clamp the frames.

9. The multilevel clamp device as set forth in claim 8, further comprising:

a panel being coupled to a pair of said mountings, said mountings being positioned adjacent a pair of side edges of said panel such that said one of said mountings is positioned opposite the other of said mountings, said panel being for maintaining positioning of said mountings and said clamps when said clamps are engaged by said mountings coupled to said panel.

10. A multilevel clamp device for clamping multiple frames at different levels, the multilevel clamp device comprising:

a plurality of clamps being adapted for engaging the frames such that said clamps are for clamping the frames, each of said clamps comprising a pair of end walls, said end walls of one of said clamps selectively engaging said end walls of another one of said clamps to inhibit inadvertent movement of one of said clamps with respect to the other one of said clamps when one of said clamps is stacked onto another one of said clamps;

each of said end walls of each of said clamps comprising a plurality of tab portions and a plurality of grooves, each of said grooves extending into the associated one of said end walls, said tab portions of each of said end walls extending downwardly from the associated one of said end walls such that said tab portions are positioned opposite said grooves of the associated one of said end walls, said tab portions of said end walls of one of said clamps being selectively positioned in said grooves of said end walls of another one of said clamps to maintain positioning of one of said clamps with respect to other one said clamps when said clamps are stacked;

each of said clamps comprising a clamping assembly, said clamping assembly being coupled between said end walls of the associated one of said clamps, said clamping assembly of each of said clamps being adapted for engaging one of the frames such that said clamping assembly is for clamping an associated one of the frames between said clamping assembly and one of said end walls of the associated one of said clamps;

said clamping assembly of each of said clamps comprising a bar and a block, said block being slidably coupled to said bar such that said block is selectively slid along a length of said bar, said bar being coupled between said end walls of the associated one of said clamps such that said block is selectively positioned between said end walls of the associated one of said clamps, said block being adapted for engaging one of the frames to clamp the associated one of the frames between said block and one of said end walls of the associated one of said clamps;

said bar of said clamping assembly of each of said clamps comprising a channel, said channel extending into said bar and extending along a length of said bar, said block being slidably positioned in said channel of said bar such that said block is selectively slid along the length of said channel to accommodate frames positioned between one of said end walls and said block, said block extending upwardly from said channel of said bar such that said block is adapted for engaging one of the frames;

said clamping assembly of each of said clamps comprising a rod, said rod being positioned in said channel of said bar, said rod being rotatably coupled to said end walls of the associated one of said clamps, said block being operationally coupled to said rod such that said block is slid along said channel of said bar when said rod is rotated;

said rod being threaded such that said rod threadably engages said block, said block moving along said rod and sliding along said channel when said rod is rotated;

said clamping assembly of each of said clamps comprising a pair of bolt heads, each of said bolt heads being coupled to said rod such that one of said bolt heads is positioned opposite the other one of said bolt heads, said bolt heads extending outwardly from the associated one of said end walls such that each of said bolt heads is selectively engaged to rotated said rod to slide said block along said channel of said bar;

a plurality of mountings selectively engaging said end walls of said clamps, said mountings being for maintaining alignment of said clamps when said clamps are used to clamp the frames; and a panel being coupled to a pair of said mountings, said mountings being positioned adjacent a pair of side edges of said panel such that said one of said mountings is positioned opposite the other of said mountings, said panel being for maintaining positioning of said mountings and said clamps when said clamps are engaged by said mountings coupled to said panel.

11. A multilevel clamp device for clamping multiple frames at different levels, the multilevel clamp device comprising:

a plurality of clamps for clamping the frames, each of said clamps comprising a pair of end walls, said end walls of one of said clamps selectively engaging said end walls of another one of said clamps to inhibit movement of one of said clamps with respect to another one of said clamps when one of said clamps is stacked onto the another one of said clamps; and each of said clamps comprising a clamping assembly, said clamping assembly being extending between and coupling said end walls of an associated one of said clamps, said clamping assembly clamping an associated one of the frames between said clamping assembly and one of said end walls of the associated one of said clamps;

wherein each of said end walls of each of said clamps includes at least one tab portions and at least one groove, said at least one groove extending into the associated one of said end walls, said at least one tab portion of each of said end walls extending downwardly from the associated one of said end walls such that said at least one tab portion is positioned opposite said at least one groove of the associated one of said end walls, said at least one tab portion of said end walls of one of said clamps being selectively positionable in said at least one groove of said end walls of another one of said clamps to maintain positioning of one of said clamps with respect to other one said clamps when said clamps are stacked.

12. The multilevel clamp device as set forth in claim 11, further comprising:

said clamping assembly of each of said clamps comprising a bar and a block, said block being slidably coupled to said bar such that said block is selectively slid along a length of said bar, said bar being coupled between said end walls of the associated one of said clamps such that said block is selectively positioned between said end walls of the associated one of said clamps, said block being engagable with one of the frames to clamp the associated one of the frames between said block and one of said end walls of the associated one of said clamps.

13. The multilevel clamp device as set forth in claim 12, further comprising:

said bar of said clamping assembly of each of said clamps comprising a channel, said channel extending into said bar and extending along a length of said bar, said block being slidably positioned in said channel of said bar such that said block is selectively slidable along the length of said channel to accommodate frames positioned between one of said end walls and said block, said block extending upwardly from said channel of said bar such that said block is engagable with one of the frames.

14. The multilevel clamp device as set forth in claim 13, further comprising:

said clamping assembly of each of said clamps comprising a rod, said rod being positioned in said channel of said bar, said rod being rotatably coupled to said end walls of the associated one of said clamps, said block being operationally coupled to said rod such that said block is slid along said channel of said bar when said rod is rotated.

15. The multilevel clamp device as set forth in claim 14, further comprising:

said rod being threaded such that said rod threadably engages said block, said block moving along said rod and sliding along said channel when said rod is rotated.

16. The multilevel clamp device as set forth in claim 11, further comprising:

a plurality of mountings selectively engaging said end walls of said clamps, said mountings being for maintaining alignment of said clamps when said clamps are used to clamp the frames.

17. The multilevel clamp device as set forth in claim 16, further comprising:

a panel being coupled to a pair of said mountings, said mountings being positioned adjacent a pair of side edges of said panel such that said one of said mountings is positioned opposite the other of said mountings, said panel being for maintaining positioning of said mountings and said clamps when said clamps are engaged by said mountings coupled to said panel.

* * * * *